United States Patent [19]

Buisson

[11] 4,196,739

[45] Apr. 8, 1980

[54] SMOKABLE TOBACCO FIBER-MATERIAL

[75] Inventor: Jean Buisson, Orleans, France

[73] Assignee: Service d'Exploitation Industrielle des Tabacs et des Allumettes, Paris, France

[21] Appl. No.: 851,633

[22] Filed: Nov. 15, 1977

[30] Foreign Application Priority Data

Nov. 18, 1976 [FR] France ..... 76 34711

[51] Int. Cl.[2] ..... A24B 3/18

[52] U.S. Cl. ..... 131/17 R; 131/140 C

[58] Field of Search ..... 131/17 R, 17 A, 17 AC, 131/17 AD, 17 AE, 31, 79, 109 B, 133 R–135, 140 B, 140 C, 142 R, 143, 146, 147 R

[56] References Cited

U.S. PATENT DOCUMENTS

| | | | |
|---|---|---|---|
| 2,626,612 | 1/1953 | Pearce | 131/17 AE |
| 2,656,841 | 10/1953 | Gurley, Jr. | 131/140 P |
| 2,887,414 | 5/1959 | Rosenberg et al. | 131/17 AC |
| 3,297,039 | 1/1967 | Osborne et al. | 131/17 AE |
| 3,409,027 | 11/1968 | de la Burde | 131/147 R |
| 3,628,541 | 12/1971 | Buchman et al. | 131/140 C |
| 3,646,943 | 3/1972 | Blewitt | 131/140 C |
| 4,076,030 | 2/1978 | Smith | 131/140 P |

FOREIGN PATENT DOCUMENTS

| | | | |
|---|---|---|---|
| 971487 | 9/1964 | United Kingdom | 131/140 C |
| 1256529 | 12/1971 | United Kingdom | 131/140 P |

*Primary Examiner*—Robert W. Michell
*Assistant Examiner*—C. F. Rosenbaum
*Attorney, Agent, or Firm*—Holman & Stern

[57] ABSTRACT

A smokable material for the tobacco industry, characterized in that it is formed in its major part with coherent spheroidal aggregates of entangled tobacco fibers having no preferential direction.

7 Claims, No Drawings

SMOKABLE TOBACCO FIBER-MATERIAL

The present invention relates to a new material to be smoked by the consumer.

This new material comprises for the major part coherent spheroidal aggregates of entangled tobacco fibers without any preferential directions.

Such new material is obtained particularly well from some elements of the tobacco plant. However, it appears as obvious that such a material would be of equivalent interest if it was obtained from similar elements of other plants which are smokable or likely to be made smokable. It is also more than probable that some synthetic smokable materials would be improved if they were under the shape of said new material. In the present specification therefore, these various subtitutes will be assimilated to tobacco with which, or with extracts of which, they might actually be mixed in any proportion. The invention relates also to the various smokable products which can be manufactured wholly or partly with the new material.

Compared to the various known materials, said new material offers a number of advantages which, till now, it was never possible to conciliate. Firstly, said material is as a matter of fact more economical from all points of view; on the one hand, it allows to incorporate in the end-products far larger proportions than previously of elements from the tobacco plant with little commercial value (leaf veins, ribs and stalks); on the other hand, it leads to the production of semi-products of very low specific weight preserving integrally such a quality while they are being transformed into smokable articles. Moreover, the necessary equipments for preparing the new material as well as for said transformation require only limited investments.

Secondly, the material according to the invention may be used for manufacturing smokable articles presenting, according to the attitude and judgments prevailing world-wide, a much reduced risk for the smoker's health: notably, the tar content of the smoke from such articles is particularly low. It is remarkable that, compared to reference articles manufactured according to conventional techniques from the same tobacco elements, the reduction of the tar content is largely in excess of what was to be expected from the mere diminution of the global mass of articles (said diminution being allowed, for an equal compactness, by the already mentioned lesser bulk density). The main reason for this astonishing progress is that the material according to the invention behaves, within the smokable article, as a real filter. Its efficiency as regards the particulate phase (tars) as well as the gaseous phase, may be such in fact that it will be possible to supply the smoker with cigarettes without filter as "light", for an equal length of the stump, as cigarettes provided with the most efficient filters on the market. Under the concept of "lightness" are included here the various parameters generally used for assessing the diminution of tar and irritating components contents of the gaseous phase in relation to cigarettes of specified characteristics used as reference.

The preparation of the aggregates according to the invention comprises two essential operations: reducing some elements of the plant into independent fibres, then entangling said fibers into coherent spheroidal, isotropic aggregates of low specific mass. Although various treatments may precede, separate, alternate or follow the two above mentioned operations, said operations are nevertheless the main phases of the process from which depend in the first place the intrinsic qualities of the materials obtained, qualities which have no equivalent in the tobacco-based products known so far.

Techniques similar to those used for obtaining paper pulp are already currently applied to tobacco, and more especially to its most ligneous parts (leaf veins, ribs, and even stalks). After grinding and refining, with or without chemical action, it is known how to separate for instance in presses the liquor containing the soluble parts and the pulp formed mainly of very disintegrated fibres. Diluted in water, this pulp will be fed to the flow box of a machine similar to the paper making machines where, once drained, pressed and dried, it forms a rather coherent leaf. Such a leaf which is impregnated with concentrated extracts from the liquor containing the soluble parts will form a smokable product, a "restored tobacco", which may be used as a substitute for natural tobacco leaves.

The main difference between this well-tried technique and the process for preparing the material according to the invention lies in the type of structure which is formed from the fibers once they have been made independent. According to the conventional practice, everything in the means used combines for inter-mingling the fibers, but with an orientation in directions parallel to the plane of the leaf which is formed. Even if the latter was manufactured with a notable thickness, one would be faced with a structure with two dominent dimensions, and a microscopic examination would always allow to distinguish the direction of the manufacturing thickness. On the contrary, with the process according to the invention, particular attention is payed to forming structures as isotropic as possible. The fibers get tangled-up in the three dimensions and it is impossible to distinguish in the semi-manufactured products any preferential direction.

It is such a tri-dimensional structure which confers to the coherent fiber aggregates two of their most advantageous qualities for their use as smokable articles: their low specific mass and their filtering power. Such features are resulting from the fact that, although the aggregates are of remarkable constitution regularity when they are observed under a high magnification, the entangled pattern formed by the fibers is absolutely "random". The proportion of empty space is thereby far superior to that which may be obtained, when adding up all the favourable factors, in a leaf manufactured according to the paper making techniques. In order to clarify ideas, it will be noted that when in leaves manufactured in such a way, the proportion of empty space reaches 50%, such leaves hardly offer any more coherence and break up under small stresses. On the contrary, aggregates manufactured according to the process of the invention may comprise a proportion of empty space exceeding 75% and yet preserve a satisfactory coherence when they are subjected to various stresses, whatever the direction of said stresses. Their tensile strength is, in all directions of the aggregate, at least equal to that of a leaf twice as compact, and their elasticity after compression, characterized by the tendency to resume their initial volume when such a stress stops, exceeds by far that which is measured on cut standard tobacco qualities having the best behaviour in this respect.

A better characterization of the difference of behaviour of the aggregates according to the invention and the tobacco leaves restored by a paper making method will be obtained by studying their tensile strength in the wet state. For the latter, an imbibition with a mass of water equivalent to the original mass results in the collapse of said tensile strength which is divided by a factor of the order of ten as an indication. For the aggregates according to the invention, such an imbibition will only reduce the tensile strength in a far smaller proportion, the quotient of the measured tensile strengths being mostly inferior to two and never reaching five.

The filtering power of the tobacco fiber aggregates as regards tars can also be explained by the fact that they do not provide smoke with any preferential passage through which said smoke could flow without turbulence. Although the draught through the fiber mass is easy due to the high proportion of empty space, the unceasing changes of direction caused by the absolutely random orientation of the fibers multiply the trapping possibilities for the tar particles. On the other hand, it is far less understood how the same aggregates can have a quite appreciable efficiency as regards the gaseous phase of the smoke. It may be that such a natural disposition is a result of the large specific surface of the product and of the formation of micropores.

There will now be given an example of the process for preparing the material according to the invention. It will clearly appear that the operational mode which is indicated may be completed by a number of operations well known per se according to the parameters of the end-products which it is desired to influence preferably to others. Such modifications are within reach for any technical man performing similar operations in other modes of operation involving the smokable products. It is not one of the least interests of the new proposed technique to allow in fact, at different stages of its development, most of the interventions which have proved of interest in other circumstances.

There is provided an intimate mixture in the dry state of 70 kg of black tobacco ribs and leaf veins, free of dust, freshly obtained from a threshing chain treating fermented tobaccos and 30 kg of tobacco stalks cut into bits. Such stalks had been previously stripped of their bark and reduced into bits of an average length of 50 millimeters with sides of 3 to 5 mm by a series of preliminary operations. Such operations comprised cutting of the fresh stalks, a first run in the threshing machine, sifting, a rigorous drying, splitting by passing between two rotating cylinders with a clearance of 8 mm, a new run through the threshing machine and a last sifting, all said operations having a ponderal efficiency of 80% of the dry matter.

The batch of 100 kg of ribs, leaf veins and stalks has thereafter been subjected, after moderate wetting, to repeated operations of steam humidification till the moisture content reached 38% (3.8 gr of water and 10 gr of chopped-up wet matter). The batch was then chopped-up in a device of the type described in French Pat. No. 1.494.175 registered on July 21, 1966 by the Applicant. With such a device, the ribs (and the elements of same general shape may be cut transversely to their length, that is perpendicularly to the general direction of the ligneous rays forming a frame-work for these elements. The speed of the forwarding mechanisms for the layer towards the cutting blades and the periodicity of the action of these blades have been adjusted in relation to one another so tht the "cutting width" (in this precise case, the length of the rib comprised between two successive cuts) be of the order of 3 mm. The fine parts (about 2 kg) were eliminated by sifting.

The collected bits were gathered in a pressure vat provided with a bottom stirrer and a steam-jacket regulated with a thermostat. There were added 700 liters of water, then 50 liters of a concentrated caustic solution containing 18 kg of soda and 4 kg of sodium sulphide. The temperature was raised in two hours to 140° C. and maintained for four hours at this value. After cooling for one night, the vat was opened; the brown cooking liquor was drained and collected in a vat refrigerated at 4° C. where it was neutralized with sodium bicarbonate (2.4 kg).

The solid residues of the ribs and stalks were washed twice with fresh tap water for thirty minutes in their cooking vat; then, 750 liters of rain water were added a second time while stirring. While maintaining the bottom stirrer in operation, the relatively homogeneous suspension which had formed was pumped continuously at the rate of 8 liters per minute about. The flow was directed continuously towards a refiner with two levels of smooth plates from where it came out as a very homogeneous paste collected in a stirrer. This paste contained an average of 78 grammes per liter of solid matter.

In order to transform it into aggregates, 100 liters of this paste were collected at each operation and transferred into a cylindrical vat rotating about its axis inclined at 30° over the horizontal. This vat, with a diameter of 80 centimeters and a length of 2 meters, was driven at a speed of 15 revolutions per minute in normal running conditions by a speed variator allowing very progressive starts and stops.

For the first operation, there was introduced in the vat, together with the paste, an equal volume of 100 liters of fresh water. For the following operations, the volume of paste introduced was also split in two but using then the dripping water from the aggregates formed during the preceding operation.

Each operation lasted about six hours thirty minutes between the introduction of the paste and the removal of the content of the vat after thirty minutes of rest, it being impossible to distinguish, due to the opacity of the walls, if the total duration could have been shortened. About sixty liters of the supernatent liquid were first collected, and a slightly smaller volume of liquid of the same appearance was then drawn off. The residual content of the vat was then discharged on all the surface of a vat of one meter by 50 centimeters with a bottom made of a small mesh wire-gauze. The layer was rather irregular and had an average thickness of 7 centimeters. This thickness seemed practically unchanged after one night of drainage at room temperature during which the quantity of clear liquid collected under the gauze was relatively small (10 to 30 liters).

On the following day, the vat was introduced into a hot air drying chamber. After a two hour treatment, at the end of which the temperature of the fluid above the layer reached 105 degrees, the vat was taken out of the drying chamber. It was established that the product it contained was apparently perfectly dry. In fact, its measured moisture content was comprised between 5 and 7%. It was formed of spheroidal granules of remarkable regularity of dimensions for most of them: over 95% in weight of each sampling had an average radius within the range of 4 to 6 millimeters. It was thus possible to collect in eight successive operations 58.5 kg of very light aggregates, after passage through a four mesh per inch sift. Their global volume was approaching 530 liters, their apparent density was of the order of 0.11 which is remarkably low.

The aptitude of such aggregates to absorb liquids, even thick, while preserving their coherence, is also quite surprising. It was possible to soak one liter with one hundred fifty cubic centimeters of the concentrated cooking brown liquor (that is reduced under vacuum to four times its initial volume until it contained 400 grammes per liter of solid matter) without giving to the touch the impression to be wet. Their coherence does not seem at all affected although their actual moisture content is then over 30%. After prolonged drying in hot air, this imbibition operation may be started again under the same conditions; this provides the possibility to practically find back the balance between the inital fibrous fractions and soluble fractions while remaining within the range of low specific masses; the latter in fact does not exceed 300 grammes per liter of dry products, that is at a moisture content comprised between 5 and 10%.

The use of these granulates may be effected in various manners: due to their fluidity, they may be introduced very regularly into the suction shaft of a cigarette making machine the distributor of which is supplied on the other hand with fine standard quality cut tobacco (0.6 mm). The mixture is achieved remarkably well in the most varied proportions. Thus, it was possible to manufacture cigarettes with a unit mass which was hardly exceeding half of those manufactured solely from the standard quality obtained from cut leaves, whereas their measured compactnesses were practically similar. The tar contents per puff were also substantially smaller for the former, with a far better regularity between puffs all along the combustion of the article.

Such aggregates may also be agglomerated together by coating them with a small quantity of a binder known for its aptitude to burn with the tobacco without giving off suspect products or change too much the smell of the smoke. It is thus possible to form cylindrical twists of the same diameter as the standard cigarettes and distinctly compacter in spite of a far smaller filling density. If they are wrapped into a paper of low air permeability, one obtains cigarettes with a draught which is only slightly differing from that of articles with a unit mass which is nevertheless two to three times higher. The regularity of their combustion, whether free or forced, appears remarkable. The firmness of the ashes does not give rise to any problem. Tasters have found the smoke of such cigarettes particularly sweet and pleasant. The total tar yield does not reach one fifth of that from standard cigarettes allowing the same number of puffs to be drawn.

What I claim is:

1. A smokable material for the tobacco industry, formed in its major part with coherent spheroidal aggregates of entangled tobacco fibers having no preferential direction, said material having an apparent density lower then 0.2 grammes/liter.

2. Process for the preparation of smokable material having an apparent density lower than 0.2 grammes per liter comprising the steps of reducing the tobacco into fibers independent of each other, stirring said fibers in a fluid medium in such manner that they are entangled and transformed into coherent and isotropic spheroidal aggregates having no preferential direction, removing the fluid medium and drying the resultant material.

3. Process according to claim 2, characterized in that the reduction into independent fibers is effected on the most ligneous elements of the tobacco, mainly the leaf veins and the stalk of the plant.

4. Process according to claim 2, characterized in that the reduction into fibres is achieved together with a solubilization of the tobacco constituent extractable in water.

5. Process according to claim 4, characterized in that the transformation of the fibres into coherent aggregates is effected without the presence of the major part of the elements extractable in water.

6. Process according to claim 2, characterized in that the coherent aggregates are impregnated with an aqueous solution until their apparent specific mass is practically doubled, a major part of the additional water thus introduced being thereafter evaporated.

7. Process according to claim 6, characterized in that the impregnation aqueous solution for the aggregates contains at least one part of the constituents extracted from the fibres by the water during the reduction into fibres.

* * * * *